US010504441B2

(12) United States Patent
He et al.

(10) Patent No.: US 10,504,441 B2
(45) Date of Patent: Dec. 10, 2019

(54) PIXEL INTERNAL COMPENSATION CIRCUIT AND DRIVING METHOD

(71) Applicant: Shenzhen China Star Optoelectronics Semiconductor Display Technology Co., Ltd., Shenzhen (CN)

(72) Inventors: Jian He, Shenzhen (CN); Shensian Syu, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/744,829

(22) PCT Filed: Nov. 16, 2017

(86) PCT No.: PCT/CN2017/111407
§ 371 (c)(1),
(2) Date: Jan. 15, 2018

(87) PCT Pub. No.: WO2019/037302
PCT Pub. Date: Feb. 28, 2019

(65) Prior Publication Data

US 2019/0066589 A1 Feb. 28, 2019

(30) Foreign Application Priority Data

Aug. 24, 2017 (CN) ..... 2017 1 0737280

(51) Int. Cl.
*G09G 3/3258* (2016.01)
*G09G 3/3291* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01); *G09G 2300/0819* (2013.01)

(58) Field of Classification Search
CPC .. G09G 3/3258; G09G 3/3266; G09G 3/3291; G09G 2300/0819
See application file for complete search history.

(56) References Cited

U.S. PATENT DOCUMENTS

2011/0164016 A1 7/2011 Kang
2013/0021309 A1* 1/2013 Kothari ..... G09G 3/3466 345/211

(Continued)

FOREIGN PATENT DOCUMENTS

CN 1815538 A 8/2006
CN 102982767 A 3/2013

(Continued)

*Primary Examiner* — Amit Chatly
(74) *Attorney, Agent, or Firm* — Leong C. Lei

(57) ABSTRACT

The invention discloses a pixel internal compensation circuit and riving method. The pixel internal compensation circuit comprises: first TFT (T1), with gate connected to third control signal (SCAN3), source and drain connected to data voltage (Vdata) and first node (A); second TFT (T2), with gate connected to first node (A), source and drain connected to second node (B) and high voltage power source (OVDD); third TFT (T3), with gate connected to first control signal (SCAN1), source and drain connected to first node (A) and reference voltage (Vref); fourth TFT (T4), with gate connected to second control signal (SCAN2), source and drain connected to second node (B) and initial voltage (Vini); capacitor C1, with two ends connected to first node (A) and second node (B); OLED, with anode connected to second node (B), and cathode connected to low voltage power source (OVSS). The invention provides a corresponding driving method. The invention uses parallel driving mode to (Continued)

effectively increase sensing time of threshold voltage compensation to improve compensation effect.

9 Claims, 3 Drawing Sheets

(56) References Cited

U.S. PATENT DOCUMENTS

| | | | | |
|---|---|---|---|---|
| 2017/0110055 | A1* | 4/2017 | Li | G09G 3/325 |
| 2018/0144717 | A1* | 5/2018 | Kim | G09G 5/10 |

FOREIGN PATENT DOCUMENTS

| | | | |
|---|---|---|---|
| CN | 104157240 | A | 11/2014 |
| CN | 104715726 | A | 6/2015 |
| CN | 104751804 | A | 7/2015 |
| CN | 105161051 | A | 12/2015 |
| CN | 105427803 | A | 3/2016 |
| CN | 105427809 | A | 3/2016 |
| CN | 106297662 | A | 1/2017 |
| CN | 106531074 | A | 3/2017 |

* cited by examiner

PIXEL INTERNAL COMPENSATION CIRCUIT AND DRIVING METHOD

BACKGROUND OF THE INVENTION

1. Field of the Invention

The present invention relates to the field of display techniques, and in particular to a pixel internal compensation circuit and driving method.

2. The Related Arts

The driving types of OLED can be divided, according to the driving method, into the passive matrix OLED (PMOLED) and active matrix OLED (AMOLED); wherein the AMOLED provides the advantages of pixels arranged in an array, self-luminous, and high luminous efficiency and is commonly used for high definition large-size display. AMOLED is a current-driven device and the light-emitting luminance is determined by the current flowing through the OLED. Most of the known integrated circuits (ICs) only transmit voltage signals, so the AMOLED pixel driver circuit needs to complete the task of converting the voltage signal into a current signal.

The AMOLED achieves the displaying through the driving TFT controlling the current flowing through the LED. The driving TFT is affected by light, the source and drain voltage stress and other factors in the course of the use, and results in the threshold voltage to offset, leading to affecting the current flowing through the LED and resulting in uneven panel display.

As shown in FIG. 1, a known 4T1C internal compensation circuit is shown. FIG. 2 is the corresponding driving timing sequence. The 4T1C refers to the circuit comprising four thin film transistors (TFTs) T1-T4 and a capacitor C1. In FIG. 1, the TFT T2 is the driving TFT, with the threshold voltage Vth_T2, OVDD is the high voltage power source, OVSS is the low voltage power source, SCAN1 and SCAN2 are control signals for controlling corresponding TFTs, Vdata is the data voltage, Vini is the initial point, Vref is a reference voltage. The panel manufacturers usually use the internal compensation approach to compensate the TFT threshold voltage offset for recovery. Refer to the timing sequence shown in FIG. 2. The entire internal compensation process comprises reset, sensing, data write-in, light-emitting phases. In the reset phase, T3, T4 are turned on, the node A and node B are discharged to voltage level of Vini; in the sensing phase, T1 is turned on, node A voltage level is maintained at the reference voltage Vref, node B voltage level is gradually charged by the OVDD to Vref-Vth_T2, but is lower than the activation voltage of the OLED. At this point, the equivalent capacitance C2 of the OLED maintains the node B voltage level; in the data write-in phase, T1 continues to be turned on, the data voltage Vdata is written to node A; in the light-emitting phase, T2 is turned on and the OLED starts to emit light.

As the panel resolution increases, the single-line scan time $T_{SCAN}$ becomes shorter and shorter. Since the voltage level of the data line needs to be switched between the reference voltage Vref and the data voltage Vdata, the internal compensation process of the two adjacent rows of pixels cannot overlap, therefore $T_{SENS}E<T_{SCAN}$, wherein $T_{SENSE}$ is the sensing time. The sensing process of the threshold voltage Vth must be sufficiently long for the node B to be charged completely. An incompletely charged node B results in directly the final failure. So the internal compensation approach is not applicable to high-resolution panel.

SUMMARY OF THE INVENTION

The object of the present invention is to provide an improved pixel internal compensation circuit, applicable to increase sensing time of the threshold voltage compensation.

Another object of the present invention is to provide a driving method of an improved pixel internal compensation circuit, applicable to increase sensing time of the threshold voltage compensation.

To achieve the above object, the present invention provides a pixel internal compensation circuit, which comprises:

a first thin film transistor (TFT), having a gate connected to a third control signal, a source and a drain connected respectively to a data voltage and a first node;

a second TFT, having a gate connected to the first node, a source and a drain connected respectively to a second node and a high voltage power source;

a third TFT, having a gate connected to a first control signal, a source and a drain connected respectively to the first node and a reference voltage;

a fourth TFT, having a gate connected to a second control signal, a source and a drain connected respectively to the second node and an initial voltage;

a capacitor, having two ends connected respectively to the first node and the second node;

an OLED, having an anode connected to the second node, and a cathode connected to a low voltage power source;

wherein the initial voltage being less than activation voltage of the OLED, and the difference between reference voltage and the initial voltage (reference voltage−initial voltage) being greater than threshold voltage of the second TFT.

According to a preferred embodiment of the present invention, the first control signal, the second control signal, and the third control signal have timing sequence configured for a reset phase, a sensing phase, a data write-in phase, and a light-emitting phase.

According to a preferred embodiment of the present invention, in the reset phase, the first control signal is at high voltage, the second control signal is at high voltage, and the third control signal is at low voltage.

According to a preferred embodiment of the present invention, in the sensing phase, the first control signal is at high voltage, the second control signal is at low voltage, and the third control signal is at low voltage.

According to a preferred embodiment of the present invention, in the data write-in phase, the first control signal is at low voltage, the second control signal is at low voltage, and the third control signal is at high voltage.

According to a preferred embodiment of the present invention, in the light-emitting phase, the first control signal is at low voltage, the second control signal is at low voltage, and the third control signal is at low voltage.

According to a preferred embodiment of the present invention, the first control signal, the second control signal, and the third control signal of pixels of current row and the first control signal, the second control signal, and the third control signal of pixels of adjacent row are configured so that the data write-in phase of the pixels of current row and the data write-in phase of the pixels of the adjacent row do not overlap.

The present invention also provides a driving method of the aforementioned pixel internal compensation circuit, which comprises: the first control signal, the second control signal, and the third control signal having timing sequence configured for a reset phase, a sensing phase, a data write-in phase, and a light-emitting phase.

According to a preferred embodiment of the present invention, in the reset phase, the first control signal is at high voltage, the second control signal is at high voltage, and the third control signal is at low voltage; in the sensing phase, the first control signal is at high voltage, the second control signal is at low voltage, and the third control signal is at low voltage; in the data write-in phase, the first control signal is at low voltage, the second control signal is at low voltage, and the third control signal is at high voltage; in the light-emitting phase, the first control signal is at low voltage, the second control signal is at low voltage, and the third control signal is at low voltage.

According to a preferred embodiment of the present invention, the first control signal, the second control signal, and the third control signal of pixels of current row and the first control signal, the second control signal, and the third control signal of pixels of adjacent row are configured so that the data write-in phase of the pixels of current row and the data write-in phase of the pixels of the adjacent row do not overlap.

The present invention also provides a pixel driver circuit, which comprises:

a first thin film transistor (TFT), having a gate connected to a third control signal, a source and a drain connected respectively to a data voltage and a first node;

a second TFT, having a gate connected to the first node, a source and a drain connected respectively to a second node and a high voltage power source;

a third TFT, having a gate connected to a first control signal, a source and a drain connected respectively to the first node and a reference voltage;

a fourth TFT, having a gate connected to a second control signal, a source and a drain connected respectively to the second node and an initial voltage;

a capacitor, having two ends connected respectively to the first node and the second node;

an OLED, having an anode connected to the second node, and a cathode connected to a low voltage power source;

wherein the initial voltage being less than activation voltage of the OLED, and the difference between reference voltage and the initial voltage (reference voltage–initial voltage) being greater than threshold voltage of the second TFT;

wherein the first control signal, the second control signal, and the third control signal having timing sequence configured for a reset phase, a sensing phase, a data write-in phase, and a light-emitting phase;

wherein in the reset phase, the first control signal being at high voltage, the second control signal being at high voltage, and the third control signal being at low voltage;

wherein in the sensing phase, the first control signal being at high voltage, the second control signal being at low voltage, and the third control signal being at low voltage;

wherein in the data write-in phase, the first control signal being at low voltage, the second control signal being at low voltage, and the third control signal being at high voltage.

In summary, the pixel internal compensation circuit and driving method of the present invention improves the problem of the known threshold voltage compensation time restricted by resolution, and is able to effectively increase the threshold voltage compensation sensing time through parallel driving and improve compensation result.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 3:
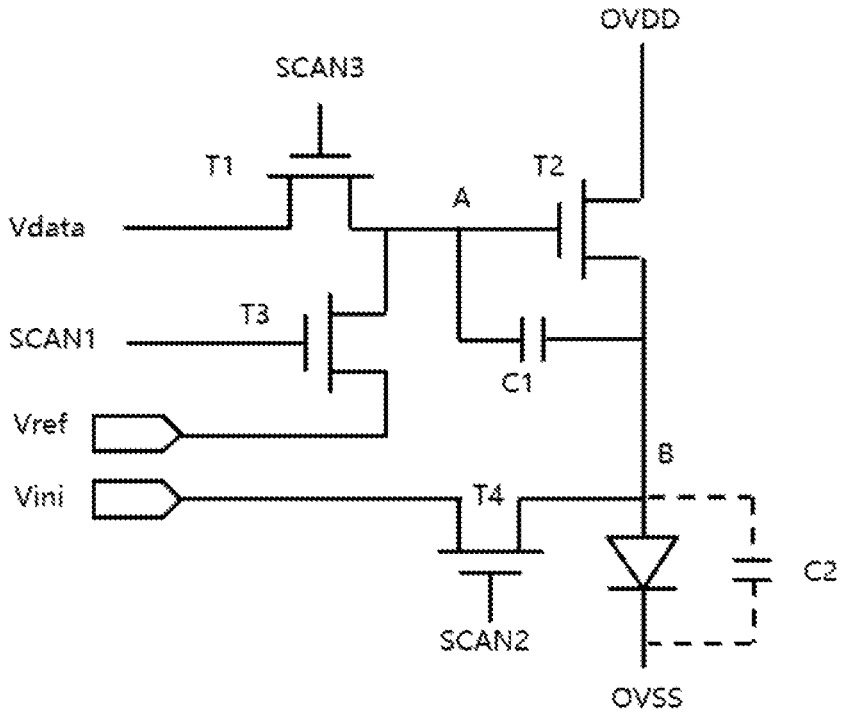
FIG. 3 is a schematic view showing the circuit of a preferred embodiment of the pixel internal compensation circuit of the present invention.

Referring to FIG. 3, FIG. 3 is a schematic view showing the circuit of a preferred embodiment of the pixel internal compensation circuit of the present invention. The preferred embodiment is a 4T1C circuit, comprising: thin film transistors (TFTs) T1-T4, and a capacitor c1. The three control signals are SCAN1, SCAN2, and SCAN3 respectively, correspondingly controlling the three TFTs T3, T4 and T1, and T2 is the driving TFT of the circuit. T1 is connected to node A and a data line for inputting data voltage Vdata, T3 is connected node A and a reference voltage Vref, and T4 is connected to node B and initial voltage Vini. In the present invention, the data line only provides Vdata, without the need to switch between Vdata and Vref as in the known technology.

The pixel internal compensation circuit of the present invention comprises: T1, having a gate connected to control signal SCAN3, a source and a drain connected respectively to data voltage Vdata and node A; T2, having a gate connected to node A, a source and a drain connected respectively to node B and high voltage power source OVDD; T3, having a gate connected to control signal SCAN1, a source and a drain connected respectively to node A and reference voltage Vref; T4, having a gate connected to control signal SCAN2, a source and a drain connected respectively to node B and initial voltage Vini; capacitor C1, having two ends connected respectively to node A and node B; OLED, having an anode connected to node B, and a cathode connected to low voltage power source OVSS; wherein Vini<activation voltage of the OLED, and Vref–Vini>Vth_T2 (threshold voltage of T2)

Figure 4:
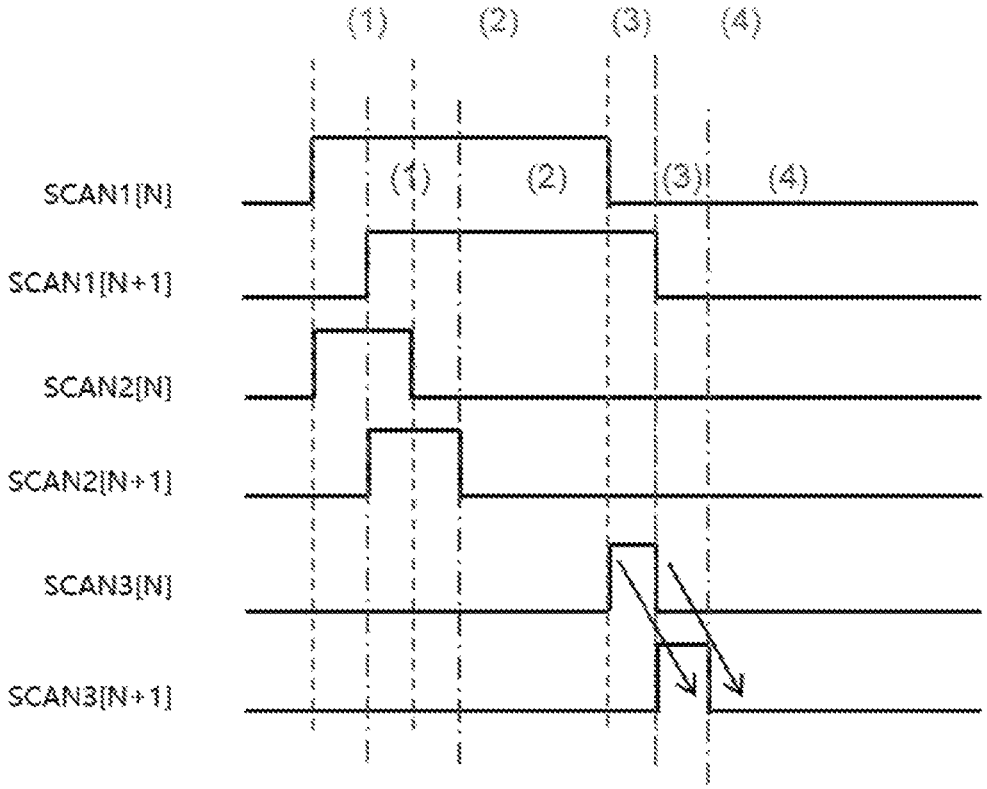
FIG. 4 is a schematic view showing the parallel driving timing sequence for a preferred embodiment of the pixel internal compensation circuit of the present invention.

Also refer to FIG. 4 for further description of the pixel internal compensation circuit of the present invention. For each row of pixels, regardless of N-th row or (N+1)-th row of pixels, the entire driving process comprises a rest phase, a sensing phase, a data write-in phase, and a light-emitting phase, which is indicated as (1), (2), (3), and (4), respectively.

(1) Rest phase: SCAN1 and SCAN2 are at high voltage, i.e., T3 and T4 are turned on; SCAN3 is at low voltage, i.e., T1 is cut-off. Node A voltage (VA) is discharged to the reference voltage Vref; node B voltage (VB) is discharged to Vini, wherein Vini is less than the light-emitting threshold voltage of the OLED Vth_OLED so ensure that the OLED does not emit light in the reset phase. Vref satisfies Vref-Vini>Vth_T2 to turn on T2, wherein Vth_T2 is the threshold voltage of T2.

(2) Sensing phase: SCAN2 becomes low voltage, i.e., T4 is cut-off. Because T2 is turned on, node B is gradually charged to the voltage level of Vref−Vth_T2. At this point, T2 is cut-off, and the equivalent capacitor C2 of the OLED maintains the voltage level of node B.

(3) Data write-in phase: SCAN1 and SCAN2 are at low voltage, i.e., T3 and T4 are cut-off; SCAN3 becomes high voltage, i.e., T1 is turned on, and node A is charged to Vdata.

(4) Light-emitting phase: SCAN1, SCAN2, and SCAN3 are pulled down to low voltage, and T1, T2, and T3 are all cut-off. OLED starts to emit light.

Figure 1:
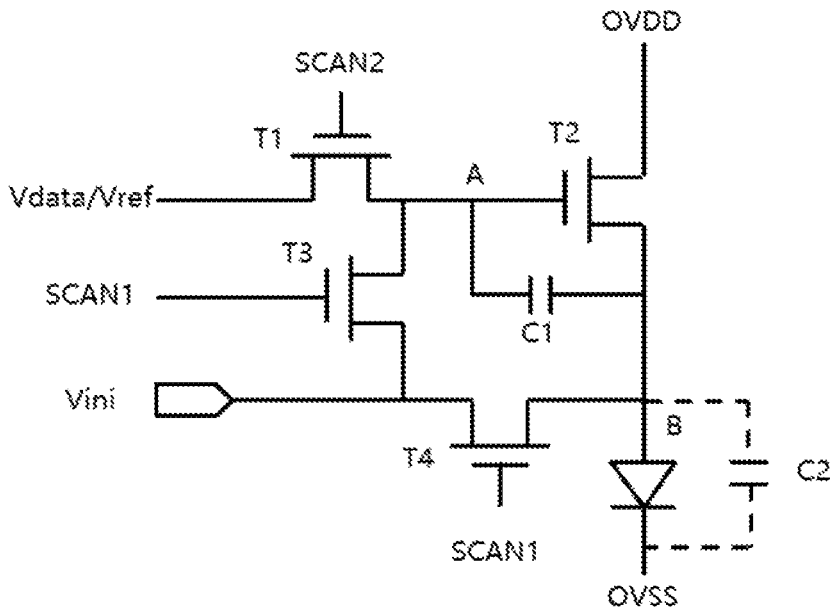
FIG. 1 is a schematic view showing a known 4T1C pixel internal compensation circuit.
Figure 2:
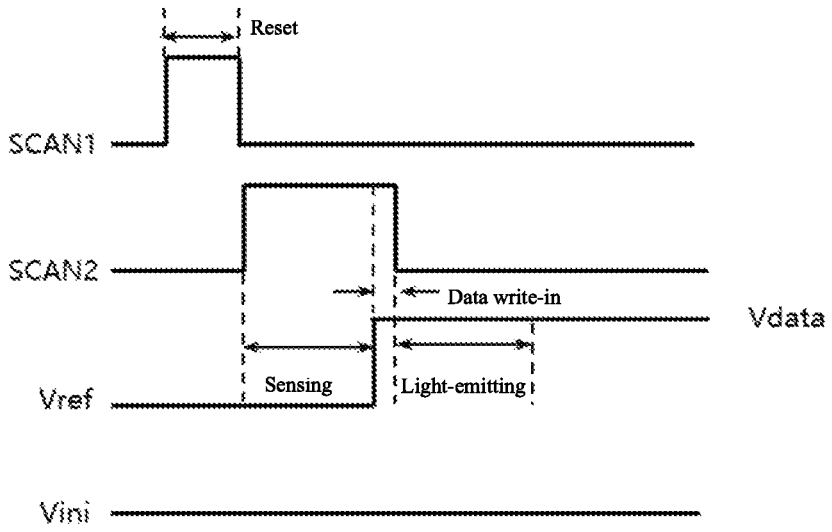
FIG. 2 is a schematic view showing the timing sequence of FIG. 1.

The pixel internal compensation circuit of the present invention improves the existing 4T1C internal compensation pixel structure and is suitable for combining the parallel driving method to improve the compensation time. Referring to FIG. 4, the parallel driving method is described by taking the parallel driving timing of the N-th row and the (N+1)-th row of pixels as an example. Since the data line only provides Vdata, without the need to switch as in the conventional circuit shown in FIG. 1, using the pixel internal compensation circuit of the present invention, the internal compensation processes of the two adjacent rows of pixels can be executed in an overlapping manner, so the parallel driving approach can be used. As long as the data write-n phases the N-th row and the (N+1)-th row does not overlap, the reset phases and the sensing phases are independent and allowed to overlap. The sensing time $T_{SENSE}$ of the threshold voltage Vth of the driving TFT is no longer restricted by the single-row scan time $T_{SCAN}$. Therefore, the $T_{SENSE}$ can be set long enough so that the node B voltage is fully charged, resulting in the threshold voltage Vth compensation effect. As such, the present invention can be applied to a high resolution panel.

The present invention also provides a driving method corresponding to the above pixel internal compensation circuit, which is suitable for combining the parallel driving mode to effectively increase the sensing time of compensating the driving TFT threshold voltage Vth and to enhance the compensation effect.

In summary, the pixel internal compensation circuit and the driving method of the present invention improve the problem that the threshold voltage compensation time is limited by the resolution, and can effectively increase the sensing time of the threshold voltage compensation by the parallel driving mode and improve the compensation effect. As such, the present invention is suitable for high resolution AMOLED panel.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A pixel internal compensation circuit, which comprises:
a first thin film transistor (TFT), having a gate connected to a third control signal, a source and a drain connected respectively to a data voltage and a first node;
a second TFT, having a gate connected to the first node, a source and a drain connected respectively to a second node and a high voltage power source;
a third TFT, having a gate connected to a first control signal, a source and a drain connected respectively to the first node and a reference voltage;
a fourth TFT, having a gate connected to a second control signal, a source and a drain connected respectively to the second node and an initial voltage;
a capacitor, having two ends connected respectively to the first node and the second node;
an OLED, having an anode connected to the second node, and a cathode connected to a low voltage power source
wherein the initial voltage is less than activation voltage of the OLED, and a difference between reference voltage and initial voltage (reference voltage−initial voltage) is greater than threshold voltage of the second TFT;
wherein the first control signal, the second control signal, and the third control signal have timing sequence configured for a reset phase, a sensing phase, a data write-in phase, and a light-emitting phase; and
wherein the first control signal, the second control signal, and the third control signal of pixels of a current row and the first control signal, the second control signal, and the third control signal of pixels of an adjacent row are configured so that the data write-in phase of the pixels of the current row and the data write-in phase of the pixels of the adjacent row do not overlap, and the reset phase and the sensing phase of the pixels of the current row respectively overlap the reset phase and the sensing phase of the pixels of the adjacent row.

2. The pixel internal compensation circuit as claimed in claim 1, wherein in the reset phase, the first control signal is at high voltage, the second control signal is at high voltage, and the third control signal is at low voltage.

3. The pixel internal compensation circuit as claimed in claim 1, wherein in the sensing phase, the first control signal is at high voltage, the second control signal is at low voltage, and the third control signal is at low voltage.

4. The pixel internal compensation circuit as claimed in claim 1, wherein in the data write-in phase, the first control signal is at low voltage, the second control signal is at low voltage, and the third control signal is at high voltage.

5. The pixel internal compensation circuit as claimed in claim 1, wherein in the light-emitting phase, the first control signal is at low voltage, the second control signal is at low voltage, and the third control signal is at low voltage.

6. A driving method of the pixel internal compensation circuit as claimed in claim 1, comprising: the first control signal, the second control signal, and the third control signal having timing sequence configured for a reset phase, a sensing phase, a data write-in phase, and a light-emitting phase, wherein the first control signal, the second control signal, and the third control signal of pixels of a current row and the first control signal, the second control signal, and the third control signal of pixels of an adjacent row are configured so that the data write-in phase of the pixels of the current row and the data write-in phase of the pixels of the adjacent row do not overlap, and the reset phase and the sensing phase of the pixels of the current row respectively overlap the reset phase and the sensing phase of the pixels of the adjacent row.

7. The driving method of pixel internal compensation circuit as claimed in claim 6, wherein in the reset phase, the first control signal is at high voltage, the second control signal is at high voltage, and the third control signal is at low voltage; in the sensing phase, the first control signal is at high voltage, the second control signal is at low voltage, and the third control signal is at low voltage; in the data write-in phase, the first control signal is at low voltage, the second control signal is at low voltage, and the third control signal is at high voltage; in the light-emitting phase, the first control signal is at low voltage, the second control signal is at low voltage, and the third control signal is at low voltage.

8. A pixel internal compensation circuit, which comprises:

a first thin film transistor (TFT), having a gate connected to a third control signal, a source and a drain connected respectively to a data voltage and a first node;

a second TFT, having a gate connected to the first node, a source and a drain connected respectively to a second node and a high voltage power source;

a third TFT, having a gate connected to a first control signal, a source and a drain connected respectively to the first node and a reference voltage;

a fourth TFT, having a gate connected to a second control signal, a source and a drain connected respectively to the second node and an initial voltage;

a capacitor, having two ends connected respectively to the first node and the second node;

an OLED, having an anode connected to the second node, and a cathode connected to a low voltage power source;

wherein the initial voltage is less than activation voltage of the OLED, and the difference between reference voltage and initial voltage (reference voltage−initial voltage) is greater than threshold voltage of the second TFT;

wherein the first control signal, the second control signal, and the third control signal have timing sequence configured for a reset phase, a sensing phase, a data write-in phase, and a light-emitting phase;

wherein in the reset phase, the first control signal is at high voltage, the second control signal is at high voltage, and the third control signal is at low voltage;

wherein in the sensing phase, the first control signal is at high voltage, the second control signal is at low voltage, and the third control signal is at low voltage;

wherein in the data write-in phase, the first control signal is at low voltage, the second control signal is at low voltage, and the third control signal is at high voltage; and wherein the first control signal, the second control signal, and the third control signal of pixels of a current row and the first control signal, the second control signal, and the third control signal of pixels of an adjacent row are configured so that the data write-in phase of the pixels of the current row and the data write-in phase of the pixels of the adjacent row do not overlap, and the reset phase and the sensing phase of the pixels of the current row respectively overlap the reset phase and the sensing phase of the pixels of the adjacent row.

9. The pixel internal compensation circuit as claimed in claim 8, wherein in the light-emitting phase, the first control signal is at low voltage, the second control signal is at low voltage, and the third control signal is at low voltage.

* * * * *